United States Patent [19]

Kinney

[11] 4,360,229

[45] Nov. 23, 1982

[54] REFUSE COLLECTION DEVICE

[76] Inventor: Frank N. Kinney, 300 Fountain Ave., Ellwood City, Pa. 16117

[21] Appl. No.: 181,126

[22] Filed: Aug. 25, 1980

Related U.S. Application Data

[63] Continuation-in-part of Ser. No. 946,540, Sep. 28, 1978, Pat. No. 4,231,602.

[51] Int. Cl.[3] ..... A01K 29/00

[52] U.S. Cl. ..... 294/1 BA

[58] Field of Search ..... 294/1 R, 1 B, 1 BA, 294/1 BB, 11, 19 R, 34, 50.9, 55, 93, 103 R; 15/104.8, 257.1, 257.6, 257.7; 248/95, 97, 99–101

[56] References Cited

U.S. PATENT DOCUMENTS

| | | | |
|---|---|---|---|
| 595,530 | 12/1897 | Diffenderfer | 294/34 |
| 1,445,269 | 2/1923 | Cupples | 248/99 |
| 2,995,329 | 8/1961 | Talcott | 248/100 X |
| 3,281,178 | 10/1966 | Fisher | 294/55 X |
| 3,446,525 | 5/1969 | Jones | 294/1 BA |
| 3,754,785 | 8/1973 | Anderson | 294/19 R |

*Primary Examiner*—Johnny D. Cherry
*Attorney, Agent, or Firm*—Harpman & Harpman

[57] ABSTRACT

A refuse collection device has an elongated handle with a sleeve slidable thereon and substantially flat rectangular body members on the handle and sleeve respectively for engagement in the open end of a disposable bag. Movement of the handle relative to the sleeve expands the bag to a full open position and secures it whereupon the bag may be turned inside out by pushing it between the substantially flat rectangular body members so that a firm smooth opening is defined by the body members into which refuse may be conveniently moved.

3 Claims, 4 Drawing Figures

REFUSE COLLECTION DEVICE

This is a continuation in part of Ser. No. 946,540, filed Sept. 28, 1978, now U.S. Pat. No. 4,231,602.

BACKGROUND OF THE INVENTION (1) Field of the Invention:

This invention relates to refuse collection devices in which plastic bags or the like are held on handles or the like so that refuse can be moved thereinto.

(2) Description of the Prior Art:

Several devices have been patented which will hold a bag with the open end of the bag in open position. See for example U.S. Pat. No. 3,754,785 wherein a clamping arm moves relative to a handle to clamp a portion of a bag against a frame.

U.S. Pat. No. 3,757,737 positions a flexible material loop in a bag and has prongs or hooks which impale portions of the bag.

U.S. Pat. No. 3,677,596 positions a wire frame in a bag opening and moves a retaining frame thereagainst and U.S. Pat. No. 4,012,067 has a bag supporting frame with a clamp on a handle of the frame engagable with the bag when folded thereover.

The present invention discloses a pair of substantially flat rectangular body members respectively mounted on an elongated handle and a sleeve slidable on the handle with the body members extending outwardly at right angles to the plane of the handle and sleeve so that the open end of a disposable bag, such as one made of plastic film, can be positioned thereover. The body members are urged together by an elastic element to receive the bag and the bag is then pushed between the body members and beneath the handle and the sleeve to position the outermost portion of the body members sufficiently within the bag to form spaced upper and lower straight edges holding the bag so that refuse may be conveniently moved thereinto.

SUMMARY OF THE INVENTION

A refuse collection device utilizes a pair of substantially flat rectangular body members on vertically spaced horizontal planes, one of the body members being affixed to an elongated handle and the other to a sleeve slidable thereon. Spring means is provided for holding the sleeve in position wherein the body member thereon is positioned adjacent to the body member on the handle and wherein a disposable plastic film bag positioned over the body members may be held open by moving the sleeve relative to the handle. Each of the body members have pairs of pointed extensions located on the edges thereof for holding the plastic film bag securely thereto. Any small piece of disposable cardboard may be used to push refuse, such as dog droppings or the like, into the bag being held in open position by the refuse collection device.

DESCRIPTION OF THE PREFERRED EMBODIMENT

Figure 1:
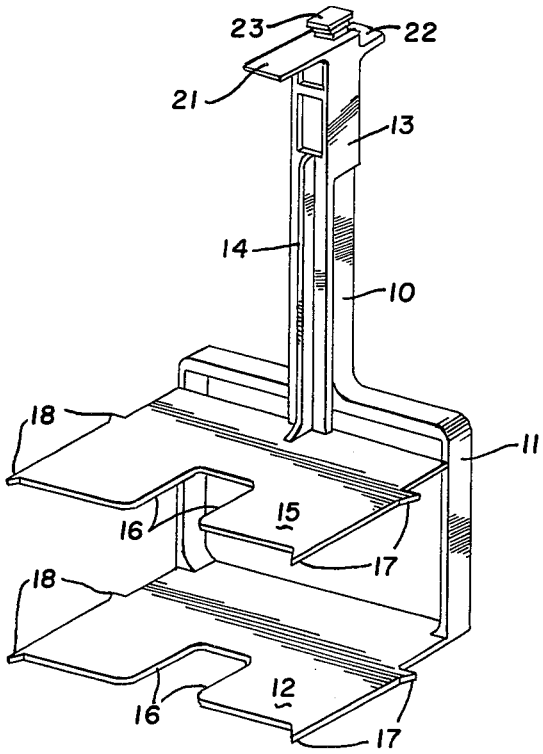
FIG. 1 is a perspective view of the refuse collection device.

By referring to the drawings and FIG. 1 in particular, it will be seen that a refuse collection device has been illustrated which comprises an elongated handle 10 having a vertically disposed rectangular frame 11 secured thereto with a rectangular horizontally disposed body member 12 attached to its lower end. The body member 12 is preferably attached to the rectangular frame 11 on oppositely disposed portions of its longitudinal sides and extends outwardly therefrom at right angles thereto. A sleeve 13 is slidably positioned on the elongated handle 10 with an offset elongated arm 14 extending downwardly therefrom with a second horizontally disposed rectangular body member 15 secured to the lower end of the arm 14 at right angles thereto. The second rectangular body member 15 is positioned above the first body member 12 for vertical movement towards and away therefrom.

Still referring to FIG. 1 of the drawings, it will be observed that both of the rectangular body members 12 and 15 have registering generally rectangular notches 16 extending inwardly from their outermost horizontal edges opposite their points of attachment.

Figure 2:
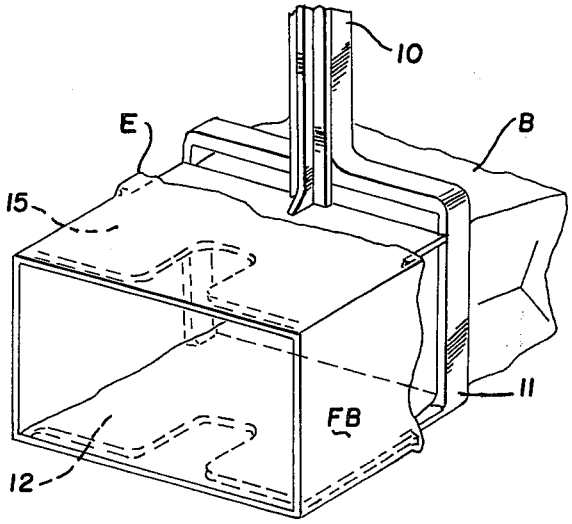
FIG. 2 is a perspective view of a portion of the device of FIG. 1 showing a plastic film bag positioned over the body members of the device and the same moved apart.
Figure 3:
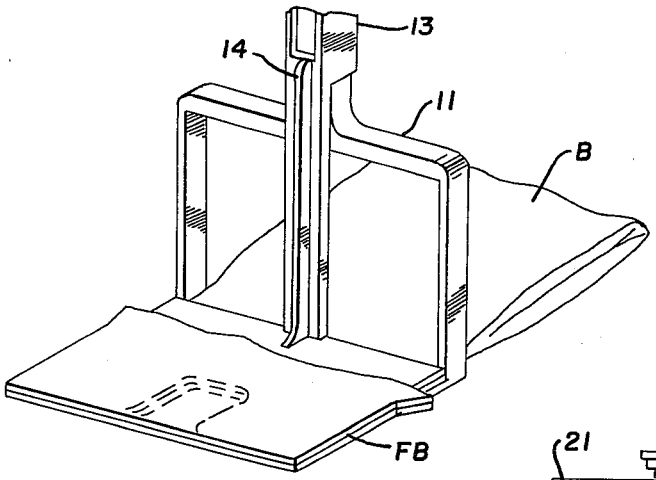
FIG. 3 is a perspective view of a portion of the device of FIG. 1 showing an alternate position of one of the body members closing the attached bag.

Pairs of pointed projections 17 and 18 are formed on the edges of the rectangular body members 12 and 15 for securing a plastic film bag B placed thereover as seen in FIGS. 2 and 3 of the drawings.

Figure 4:
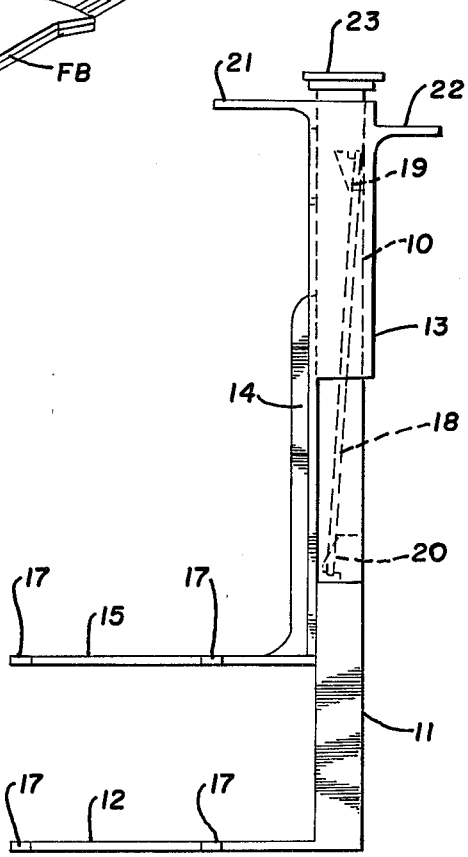
FIG. 4 is a side elevation of the device.

Referring specifically now to FIG. 2 of the drawings, the device is shown in open position with the bag end E positioned over the rectangular body members 12 and 15 which have been moved vertically apart against the tension of an elastic member 21 secured between the handle 10 and the sleeve 13 as best seen in FIG. 4 of the drawings. The plastic film bag B is thus manually held in stretched open position and is pushed between the spaced flat rectangular body members 12 and 15 and through the opening in the frame 11 so that the bag B is turned inside out and the portion thereof engaged over the body member 12 and 15 forms a cuff which securely holds the plastic film bag B on the refuse collection device.

It will be observed that the outermost portions of the flat rectangular body members 12 and 15 thus shape the open end of the bag B and form spaced horizontal smooth surfaces which facilitate the movement of refuse into the bag. When refuse has been deposited into the bag, the sleeve 13 may be released so that the body members 12 and 15 move towards one another a short distance and the folded end of the bag B which is indicated by the letters FB in FIGS. 2 and 3 moved away from the frame where it will provide sufficient material to be gathered together and secured with the usual wire tie or the like.

Referring now to FIG. 4 of the drawings, the device is shown in open position without the bag B and it will be seen that the elastic member 21 indicated in broken lines is secured to a pair of tab-like projections 19 and 20 positioned on the sleeve 13 and the elongated handle 10 respectively.

A pair of oppositely disposed sideward extensions 22 on either side of the uppermost end of the sleeve 13 provide means for holding and imparting vertical movement to the sleeve 13, arm 14 and body member 15.

A thumb rest 23 is positioned on top of the handle 10 and is used in conjunction with the extensions 22 in opening the device as shown in FIG. 4 of the drawings.

Although but one embodiment of the present invention has been illustrated and described, it will be apparent to those skilled in the art that various changes and modifications may be made therein without departing from the spirit of the invention and thus having described my invention what I claim is:

1. A refuse collection device comprising an elongated vertical handle, a vertically disposed rectangular frame on the lower end of said handle, a first horizontally disposed flat rectangular bag entering member on the lower portion of said rectangular frame extending outwardly therefrom, a sleeve movably mounted on said handle above said rectangular frame, a depending arm on said sleeve arranged in parallel relation to said handle, a secondary horizontally disposed flat rectangular bag entering member on the lower end of said arm extending outwardly therefrom, said secondary flat bag entering member arranged for vertical movement toward and away from said first flat bag entering member when said sleeve is moved longitudinally of said handle, said secondary flat bag entering member on said sleeve and arm being vertically offset below said sleeve and positioned directly above said first flat bag entering member, said flat bag entering members extending from said frame and arm respectively at right angles thereto and adapted to enter an open ended bag positioned thereover and hold and tension said bag in open end condition when moved apart vertically, an elastic element secured to said sleeve and said handle normally urging said first and second bag entering members toward one another whereby manual movement of said sleeve relative to said handle moves said bag entering members apart so as to expand said open ended bag and hold the same on said first and secondary bag entering members and permit said bag to be turned inside out so that a peripheral area of said bag is positioned around the opening thereof in folded relation over portions of said bag entering members and said elastic element urges the bag entering members and the folded bag together when said sleeve and handle are released.

2. The refuse collection device of claim 1 wherein said flat bag entering members are substantially of the same configuration and arranged to be positioned one immediately adjacent the other when said sleeve is moved along the elongated handle by said elastic element so as to faciliate the positioning of an open ended bag over the respective bag supporting members.

3. The refuse collection device of claim 1 wherein said flat bag entering members are notched along their outer horizontal edges.

* * * * *

UNITED STATES PATENT AND TRADEMARK OFFICE

CERTIFICATE OF CORRECTION

PATENT NO. : 4,360,229

DATED : November 23, 1982

INVENTOR(S) : Frank N. Kinney

It is certified that error appears in the above-identified patent and that said Letters Patent is hereby corrected as shown below:

In Figure 1 of the drawings,the numeral "21" should read ---22---.

In Figure 4 of the drawings,the numeral "21" at the top left of the Figure should read ---22---.

In Figure 4 of the drawings, the numeral "18" should read---21---.

Signed and Sealed this

*First* Day of *February 1983*

[SEAL]

*Attest:*

GERALD J. MOSSINGHOFF

*Attesting Officer*

*Commissioner of Patents and Trademarks*